US008720608B2

(12) United States Patent
Downton et al.

(10) Patent No.: US 8,720,608 B2
(45) Date of Patent: May 13, 2014

(54) WELLBORE INSTRUMENTS USING MAGNETIC MOTION CONVERTERS

(75) Inventors: Geoffrey C. Downton, Sugar Land, TX (US); Iain Cooper, Sugar Land, TX (US); Mike Williams, Sugar Land, TX (US); Robert Utter, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 563 days.

(21) Appl. No.: 12/996,660

(22) PCT Filed: May 28, 2009

(86) PCT No.: PCT/US2009/045415

§ 371 (c)(1),
(2), (4) Date: Jan. 27, 2011

(87) PCT Pub. No.: WO2009/151962

PCT Pub. Date: Dec. 17, 2009

(65) Prior Publication Data

US 2011/0120725 A1 May 26, 2011

Related U.S. Application Data

(60) Provisional application No. 61/061,470, filed on Jun. 13, 2008.

(51) Int. Cl.

| | |
|---|---|
| ***E21B 4/00*** | (2006.01) |
| ***E21B 4/14*** | (2006.01) |
| ***E21B 7/04*** | (2006.01) |

(52) U.S. Cl.

USPC ..... 175/293; 175/61; 175/296

(58) Field of Classification Search

CPC ..... E21B 4/14; E21B 4/06; E21B 6/00; E21B 1/00; E21B 7/24; E21B 31/005; E21B 21/10

USPC ..... 166/373, 66.5, 177.1; 175/293, 328, 61, 175/57, 51, 56, 105, 206; 310/103

See application file for complete search history.

(56) References Cited

U.S. PATENT DOCUMENTS

| | | | |
|---|---|---|---|
| 2,790,095 | A | 4/1957 | Peek et al. |
| 2,943,216 | A | 6/1960 | Spodig |

(Continued)

FOREIGN PATENT DOCUMENTS

| | | |
|---|---|---|
| WO | 2006065155 | 6/2006 |
| WO | WO 2007037704 A1 * | 4/2007 |

(Continued)

OTHER PUBLICATIONS

Combine Search and Examination Report for the equivalent GB patent application No. 1212260.2 issued on Jul. 30, 2012.

*Primary Examiner* — Kenneth L Thompson
*Assistant Examiner* — Michael Wills, III
(74) *Attorney, Agent, or Firm* — Chadwick A. Sullivan; Brigette Echols

(57) ABSTRACT

A directional drilling system, a drilling hammer and a fluid flow telemetry modulator use a plurality of magnets arranged to convert rotational motion into reciprocating linear motion. Various types of motor can provide rotational motion to a part of the magnets and various linkages and other devices can cause steering or operation of a modulator valve. A torsional drilling hammer uses a plurality of magnets arranged to convert reciprocating linear motion into reciprocating rotational motion. A motor and linkage drives the linearly moving part of the magnets, and the rotating part provides torsional impact be striking the linearly moving part of the magnets.

17 Claims, 14 Drawing Sheets

(56) References Cited

U.S. PATENT DOCUMENTS

| | | | | |
|---|---|---|---|---|
| 4,011,477 | A | 3/1977 | Scholin | |
| 4,958,690 | A | 9/1990 | Cyphelly | |
| 6,050,348 | A | 4/2000 | Richarson et al. | |
| 6,761,232 | B2 | 7/2004 | Moody et al. | |
| 7,151,332 | B2 | 12/2006 | Kundel | |
| 7,201,239 | B1 * | 4/2007 | Perry | 175/104 |
| 7,382,106 | B2 | 6/2008 | Kundel | |
| 7,400,069 | B2 | 7/2008 | Kundel | |
| 7,578,359 | B2 | 8/2009 | Coates et al. | |
| 2006/0157281 | A1 | 7/2006 | Downton | |
| 2007/0175662 | A1 * | 8/2007 | Kracik | 175/24 |
| 2008/0179093 | A1 * | 7/2008 | Kusko et al. | 175/40 |

FOREIGN PATENT DOCUMENTS

| | | |
|---|---|---|
| WO | 2009/028964 | 3/2009 |
| WO | 2011/149363 | 12/2011 |

* cited by examiner

WELLBORE INSTRUMENTS USING MAGNETIC MOTION CONVERTERS

BACKGROUND OF THE INVENTION

1. Field of the Invention

The invention relates generally to the field of magnetic motion converters. More particularly, this invention relates to uses for a device that converts rotary motion into axial motion by magnetic interactions, and applications of such devices in wellbore instruments.

2. Background Art

Wellbore drilling and servicing instrumentation includes percussion devices. Percussion devices include drilling "hammers" that convert flow of drilling fluid or rotational motion into reciprocating linear motion to cause a hammer bit or similar device to strike the bottom of the wellbore. The striking motion at least in part causes the wellbore to be lengthened. See, for example, U.S. Pat. No. 4,958,690 issued to Cyphelly. The device disclosed in the Cyphelly '690 patent converts flow of drilling fluid into reciprocating linear motion.

Typical reciprocating motion devices use eccentric rotation, e.g., camshafts, or use variations in hydraulic flow to reciprocate pistons which then provide the reciprocating output directly. Reciprocation may be generated without any solid surface coming into contact with another solid surface. One of the drawbacks inherent in reciprocating motion devices is that vibration from the device is conducted to other supporting elements associated with the device, e.g., portions of a drilling tool assembly (tool "string"). Such vibration can be damaging, particularly when there are sensitive electronic devices located near the reciprocating device, which is usually the case with tools such as directional drilling assemblies and logging while drilling ("LWD") tools. Hammer drills such as the one disclosed in the Cyphelly '690 patent also typically have high fluid pressure losses associated with them, which can limit the wellbore depth in which they can be used when considering the total system fluid pressure losses.

Another device for generating reciprocating linear motion from rotary motion is described in International Patent Application Publication NO. WO 2006/065155 filed by Pfahlert. There Continues to be a Need for Reciprocating Motion Devices that can be Used with Wellbore Instrumentation.

SUMMARY OF THE INVENTION

A directional drilling apparatus according to one aspect of the invention includes a housing configured to couple to a drill string. A plurality of magnets is disposed in the housing and is configured to convert rotation to reciprocating motion. The magnets are configured to impart impacts to the housing by the reciprocating motion. A motor coupled to the magnets to apply rotation to a part thereof. A control system is configured to operate the motor such that the impacts occur when the housing is in a selected rotational orientation.

A directional drilling apparatus according to another aspect of the invention include a housing configured to couple to a drill string. A plurality of magnets is disposed in the housing and is configured to convert rotation to reciprocating motion. The magnets are configured to cause lateral extension of a device from a center axis of the housing by the reciprocating motion. A motor coupled to the magnets to apply rotation to a part thereof. A control system is configured to operate the motor such that the extension occurs when the housing is in a selected rotational orientation.

A fluid flow telemetry modulator according to another aspect of the invention includes a housing configured to couple to an instrument string. A plurality of magnets is disposed in the housing and is configured to convert rotation to reciprocating motion. A motor coupled to the magnets to apply rotation to a part thereof. A valve stem coupled to a reciprocating part of the magnets. A control system is configured to operate the motor such that the valve stem is extended toward a valve seat at selected times to modulate a flow of fluid though the valve seat. A method for directional drilling according to another aspect of the invention includes rotating a first magnet assembly inside a drill string. The first magnet assembly is operatively associated with a second magnet assembly. The first and second magnet assemblies are configured to convert the rotating into reciprocating motion of the second magnet assembly. The reciprocating motion is coupled to at least one steering element associated with the drill string. The rotating is performed such that the at least one steering element is actuated when the drill string is in a selected rotary orientation.

A method for applying reciprocating torsion to a drill string according to another aspect of the invention includes linearly reciprocating a first magnet assembly. A second magnet assembly is used to convert the linear reciprocation of the first magnet assembly into reciprocating rotation of the second magnet assembly. The second magnet assembly is used to apply torsional force to the drill string at endpoints of the reciprocating rotation.

Other aspects and advantages of the invention will be apparent from the following description and the appended claims.

DETAILED DESCRIPTION

Figure 1A:
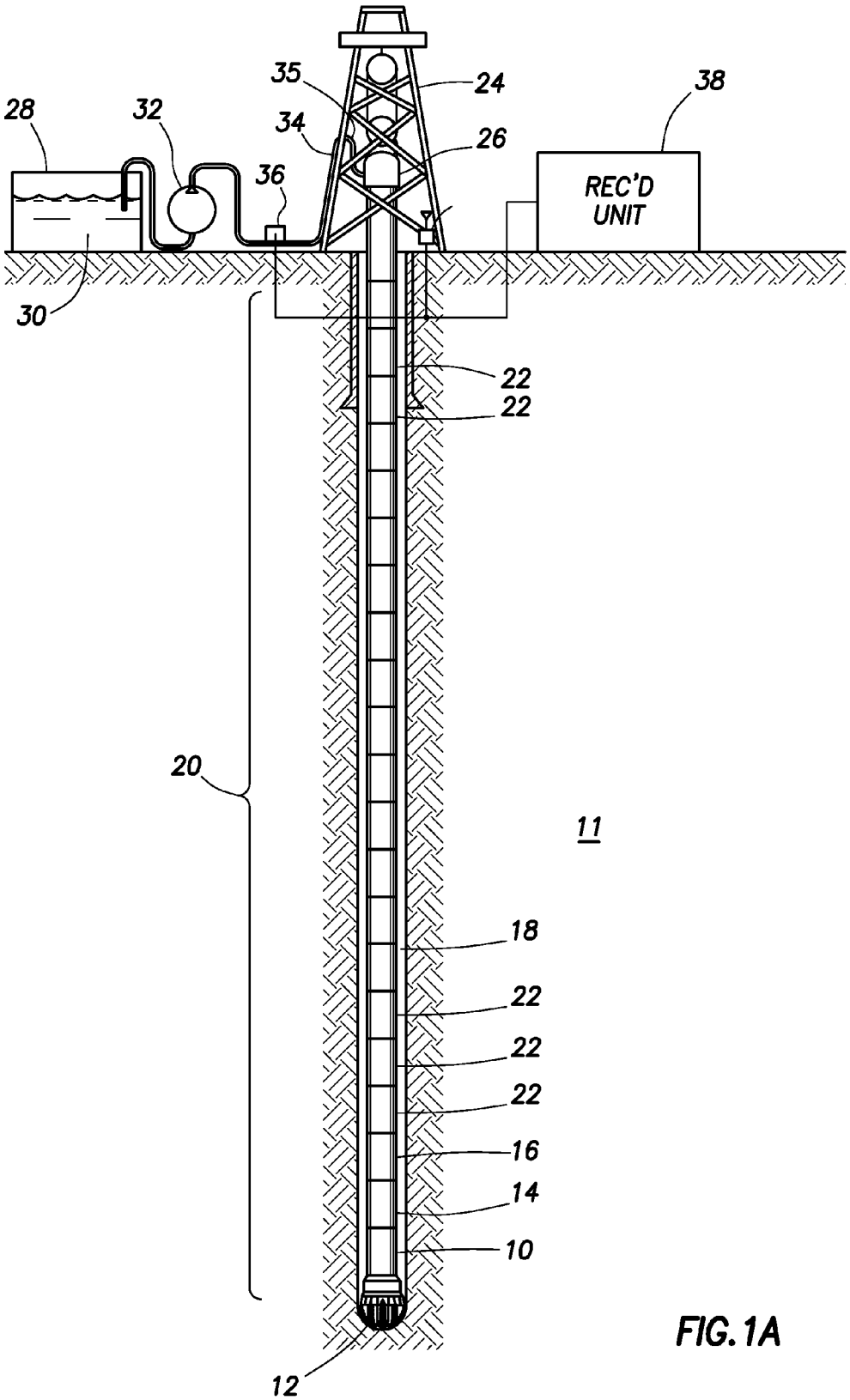
FIG. 1A shows a drilling rig and associated equipment drilling a wellbore through subsurface rock formations.

FIG. 1A shows a wellbore drilling system to illustrate possible uses for example devices according to the various aspects of the invention. In FIG. 1A, a drilling rig 24 or similar lifting device suspends a conduit called a "drill string 20" within a wellbore 18 being drilled through subsurface rock formations 11. The drill string 20 may be assembled by threadedly coupling together end to end a number of segments ("joints") 22 of drill pipe. The drill string 20 may include a drill bit 12 at its lower end. When the drill bit 12 is axially urged into the formations 11 at the bottom of the wellbore 18 by the weight of the drill string 20, and when the bit 12 is rotated by equipment (e.g., top drive 26) on the drilling rig 24 turning the drill string 20, such urging and rotation causes the bit 12 to axially extend ("deepen") the wellbore 18. The lower end of the drill string 20 may include, at a selected position above and proximate to the drill bit 12, a directional drilling steering system 10 according to various aspects of the invention and which will be further explained below. Proximate its lower end of the drill string 20 may also include a logging while drilling ("LWD") instrument 14. The directional drilling system 10 will be further explained with reference to FIGS. 1 through 10. A telemetry unit 16 may include both electromagnetic (or optical) signal telemetry devices and fluid flow modulation telemetry devices (not shown separately in FIG. 1A) to communicate commands from the surface and to communicate measurements made by the LWD instrument 14 to the surface. Commands and signals from the LWD instrument may be used in some examples to operate a control system (120 in FIG. 1, explained below) in the directional drilling system 10.

During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (see FIG. 1) in the drill bit 12, where it then cools and lubricates the drill bit 12 and lifts drill cuttings generated by the drill bit 12 to the Earth's surface. In some examples, signals from the LWD instrument 14 may be conveyed to telemetry transmitter (not shown separately in FIG. 1A, see FIG. 14) in the telemetry unit 16 that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit 38 for decoding and interpretation using techniques well known in the art. The decoded signals typically correspond to measurements made by one or more of the sensors (not shown separately) in the LWD instrument 14. One example of a mud flow modulator will be explained below with reference to FIG. 14.

It will be appreciated by those skilled in the art that the top drive 26 may be substituted in other examples by a swivel, kelly, kelly bushing and rotary table (none shown in FIG. 1A) for rotating the drill string 20 while providing a pressure sealed passage through the drill string 20 for the mud 30. Accordingly, the invention is not limited in scope to use with top drive drilling systems. It should also be clearly understood that the invention is not limited in scope to use with segmented pipe conveyance systems. It is within the scope of the present invention to convey devices into and out of a wellbore using coiled tubing and the invention may be used in each of its aspects with such coiled tubing. An example of a directional drilling system that uses magnets to convert rotational motion to reciprocating linear motion is shown in cross sectional view in FIG. 1. The system 10 may be disposed in a housing 114 that is configurable to be coupled to the drill string (20 in FIG. 1A). For example, the housing 114 may include threaded connections on its longitudinal ends. The housing 114 may be made, for example, from high strength, non-magnetic metal alloy such as monel, stainless steel or INCONEL (a registered trademark of Huntington Alloys Corporation, Huntington, W. Va.). One of the threaded connections, shown at 116 at one longitudinal end of the housing 114 may be configured to threadedly engage the drill bit 12. The drill bit 12 in the present example may be asymmetric in its drilling properties. For example, the bit 12 may include one side or circumferential segment such as the one shown at 12A that is less effective in drilling though subsurface rock formations than another side or circumferential segment shown at 12B. "Effectiveness" may be defined as a rate at which the bit will penetrate a particular rock formation for a selected axial force on the bit, a selected drilling fluid flow rate and a selected rotational speed. Such asymmetric drilling properties may be obtained, for example, by having different numbers of cutting elements (e.g., teeth or polycrystalline diamond compact cutters), different attachment angles of cutting elements or different mechanical properties of cutting elements. For purposes of explaining the present example and several examples to follow, side or segment 12A may be referred to as the "less aggressive cutting side" of the bit 12, and the other side or segment 12B may be referred to as the "more aggressive cutting side." During drilling operations, the bit 12 may be rotated and axially urged as explained above with reference to FIG. 1A. Drilling fluid (30 in FIG. 1A) is concurrently pumped through the drill string (20 in FIG. 1A) and into a central passage 124 in the housing 114. The drilling fluid may exit the bit 12 through courses or nozzles 12C of types known in the art.

The central passage 124 may be defined by a tube or conduit 129 disposed substantially coaxially with the housing 114. The conduit 129 when so disposed will also define an annular space 127 between the conduit 129 and the outer wall of the housing 114. The annular space 127 may include therein an hydraulic motor, such as a positive displacement motor consisting of a stator 186 affixed to the exterior of the conduit 129 and a rotor 128 disposed externally to the stator 186. A control system 120 such as a microprocessor based controller automatically controls operation of a valve 122, such as a solenoid operated valve. The valve 122 admits the drilling fluid into the annular space 127 upon suitable operation by the controller 120 so that drilling fluid moving through the drill string (20 in FIG. 1A) will operate the hydraulic motor (stator 186 and rotor 128). Drilling fluid discharged from the hydraulic motor may leave the annular space 127 through a suitable orifice or port 118.

The rotor 128 may be rotationally coupled through a suitable rotary coupling 131 to a drive sleeve 130. The drive sleeve 130 is shown in oblique view in FIG. 4, and is coupled to a magnetic motion converter (explained below) to cause a part thereof to rotate correspondingly with the rotor 128. Thus, a rotating part of the magnetic motion converter may be selectively rotated by suitable operation of the valve 122. The control system 120 may be in signal communication with certain sensors (not shown separately) in the LWD instrument (14 in FIG. 1A) to determine the geodetic orientation of the directional drilling system 10 as well as the geodetic trajectory of the wellbore (18 in FIG. 1A). Although the term "LWD" is usually used to refer to drilling system components containing formation evaluation sensors (the directional sensors are usually found in a part of the drilling system referred to as the MWD (measurement while drilling) system and may also contain the a pulse telemetry system for upward transmission of all the LWD data and the directional information from the inclinometer and magnetometers in the MWD system, LWD is used as shorthand in the present description for the sake of simplicity. As will be explained further below, operation of certain components in the directional drilling system 10 may cause change in the wellbore trajectory.

Figure 2:
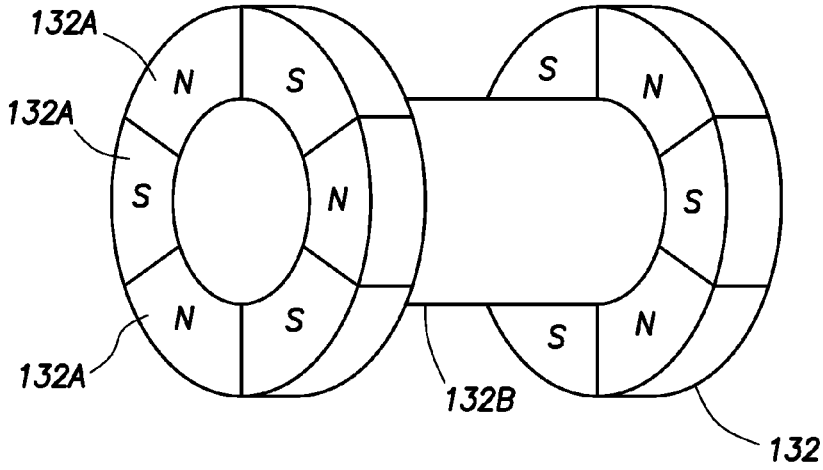
FIG. 2 shows an example anvil for the system shown in FIG. 1.
Figure 3:
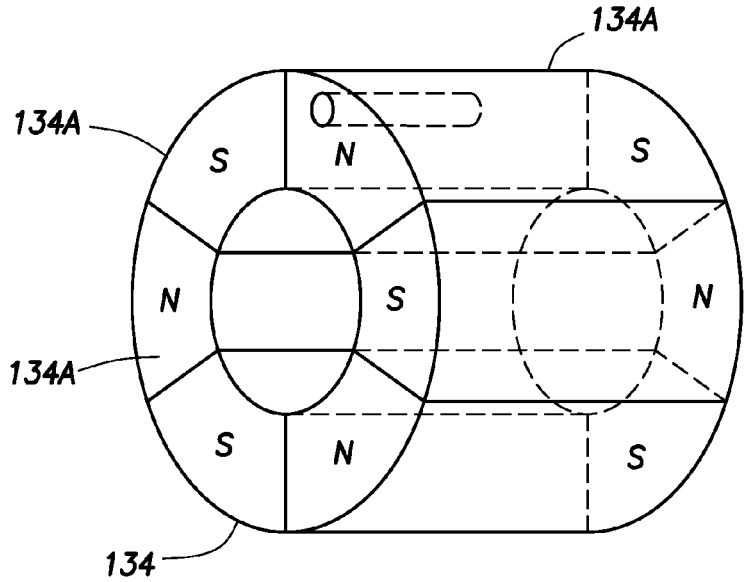
FIG. 3 shows an example shuttle for the system shown in FIG. 1.
Figure 4:
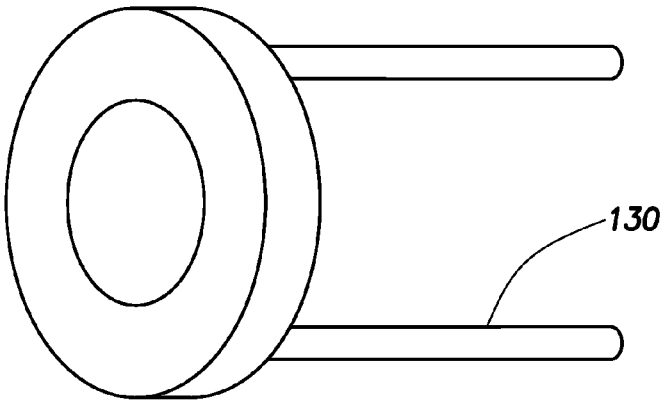
FIG. 4 shows an example of a shuttle drive sleeve.

The drive sleeve 130 is rotationally coupled to a rotating part of the magnetic motion converter. The magnetic motion converter includes a shuttle 134 and an anvil 132. The anvil 132 may be disposed on the exterior surface of the conduit 129 so that the anvil 132 is constrained to move longitudinally. When the shuttle 134 is rotated, magnets (arranged therein as shown in FIG. 3) cooperate with magnets on the anvil 132 (arranged as shown in FIG. 2) such that the anvil 132 moves longitudinally back and forth along the conduit 129. As shown in FIG. 3, the shuttle may include a plurality of magnets 134A shaped as elongated, arcuate segments that when assembled form an annular cylinder. The magnets 134A may be alternatingly longitudinally polarized such that opposed poles of any one magnet 134A are at opposed longitudinal ends thereof. The described example shows only one motion converter stage for clarity of the illustration—There may be more than one motion converter stage or a plurality of rings of magnets in other implementations. An example of the anvil 132 is shown in oblique view in FIG. 2. The anvil 132 may include a generally cylindrical center section 132B, which may be formed from a non-magnetic material such as stainless steel. Longitudinal ends of the center section 132B may include disposed thereon a plurality of circumferentially arranged, alternatingly polarized magnets 132A. The magnets 132A may be in the shape of circumferential segments of a disk as shown in FIG. 2, and may be polarized perpendicularly to the plane of the segments.

With magnets in the shuttle and anvil arranged as shown in FIG. 3 and FIG. 2, when the shuttle 134 is rotated (by the motor in FIG. 1), the magnetic fields induced by the magnets 134A alternately repel opposed sides of the magnets on the anvil (FIG. 2). In this way, rotational motion of the shuttle 134 is converted to reciprocating linear motion of the anvil 132.

Returning to FIG. 1, when the anvil 132 reaches a longitudinal end of travel, an impact may be applied to the housing 114, and thereby, to the drill bit 12. It may be desirable to enclose the magnets in the anvil in a strong, non-magnetic material such as stainless steel, monel or the previously described INCONEL alloy to enable the anvil 132 to impact the housing 114 without breaking the magnets.

It may be desirable to use, for the magnetic material for the magnets in both the shuttle 134 and anvil 132, magnetic material such as samarium-cobalt or neodymium-iron-boron in order to provide thermally stable, high magnetic flux. However, the particular materials used for the magnets is not a limitation on the scope of the present invention.

By applying the impacts at particular times during rotation of the bit 12, the bit 12 may be caused to drill in a preferred direction, thus changing the trajectory of the wellbore along a desired direction. In order to achieve a desired wellbore trajectory direction, the timing of the impacts may be controlled by the control system 120 operating the valve 122 so that the motor turns in the correct phase relationship to the rotational orientation of the housing 114. The foregoing operation of the motor and consequent impacts can ensure the impacts occur when the bit 12 is in a desired rotary orientation. When the bit 12 is in a particular rotary orientation, and an impact is provided to the housing 114, the bit 12 will cause the wellbore trajectory to turn in the direction of the more aggressive face 12B.

To summarize, by suitable control of the valve 122 and corresponding operation of the motor, the bit 12 will be impacted when the aggressive face 12B of the bit is oriented in a desired steering direction. The control system 120 uses information from toolface sensors (e.g., magnetometers) and inclinometers (e.g., in the LWD instrument 14 in FIG. 1A) to determine the existing well trajectory, the system steering direction and any corrective action to be made to the well trajectory. It is also within the scope of the present invention that to continue drilling the wellbore along the same trajectory it is possible to simply ensure the impacts are evenly distributed in all circumferential directions. Such distribution of impact may have the benefit of combined hammer drilling and straight rotary drilling. If hammer drilling is not desirable, the motion converter can be switched off.

Figure 1:
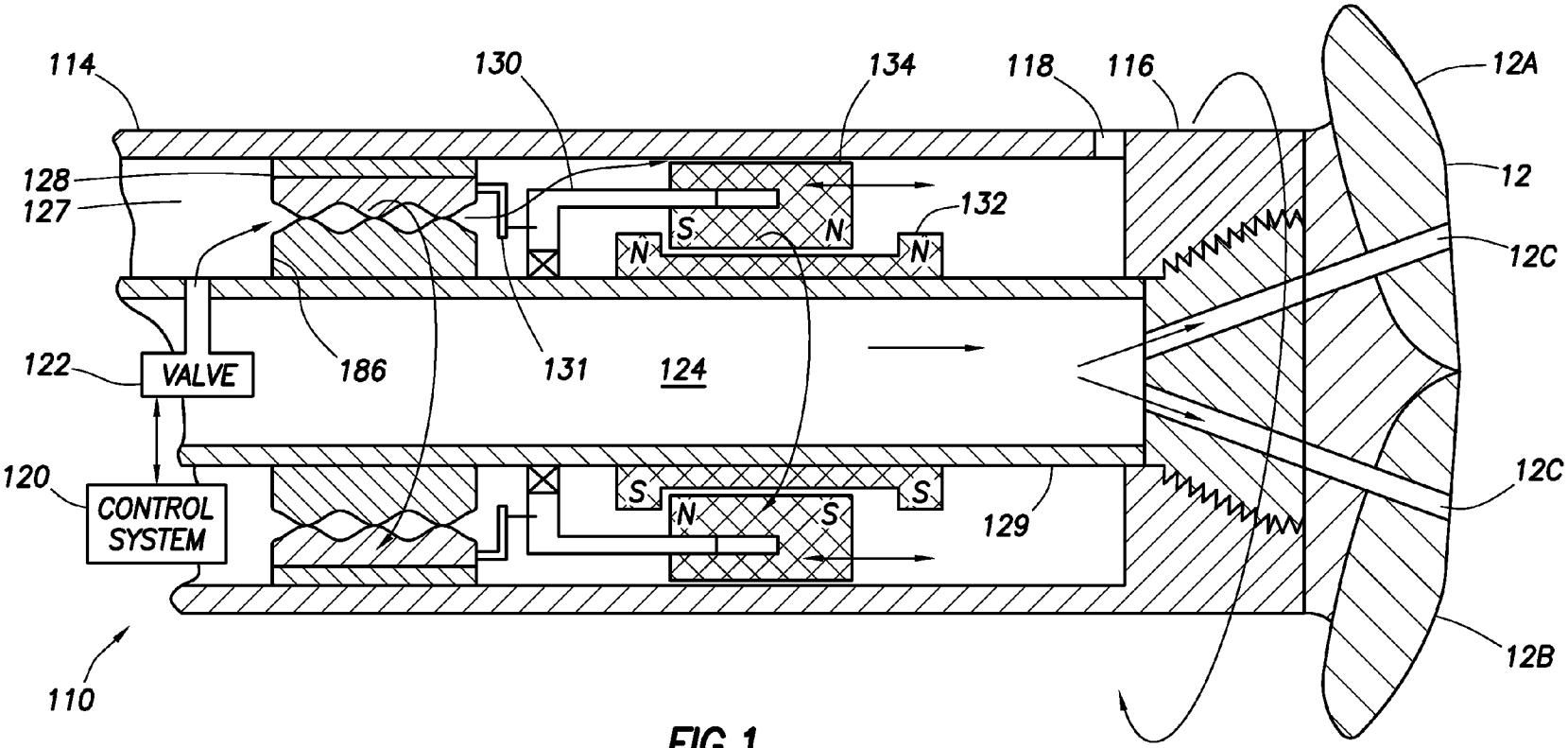
FIG. 1 shows an example of a directional drilling steering system using a magnetic motion converter.
Figure 5:
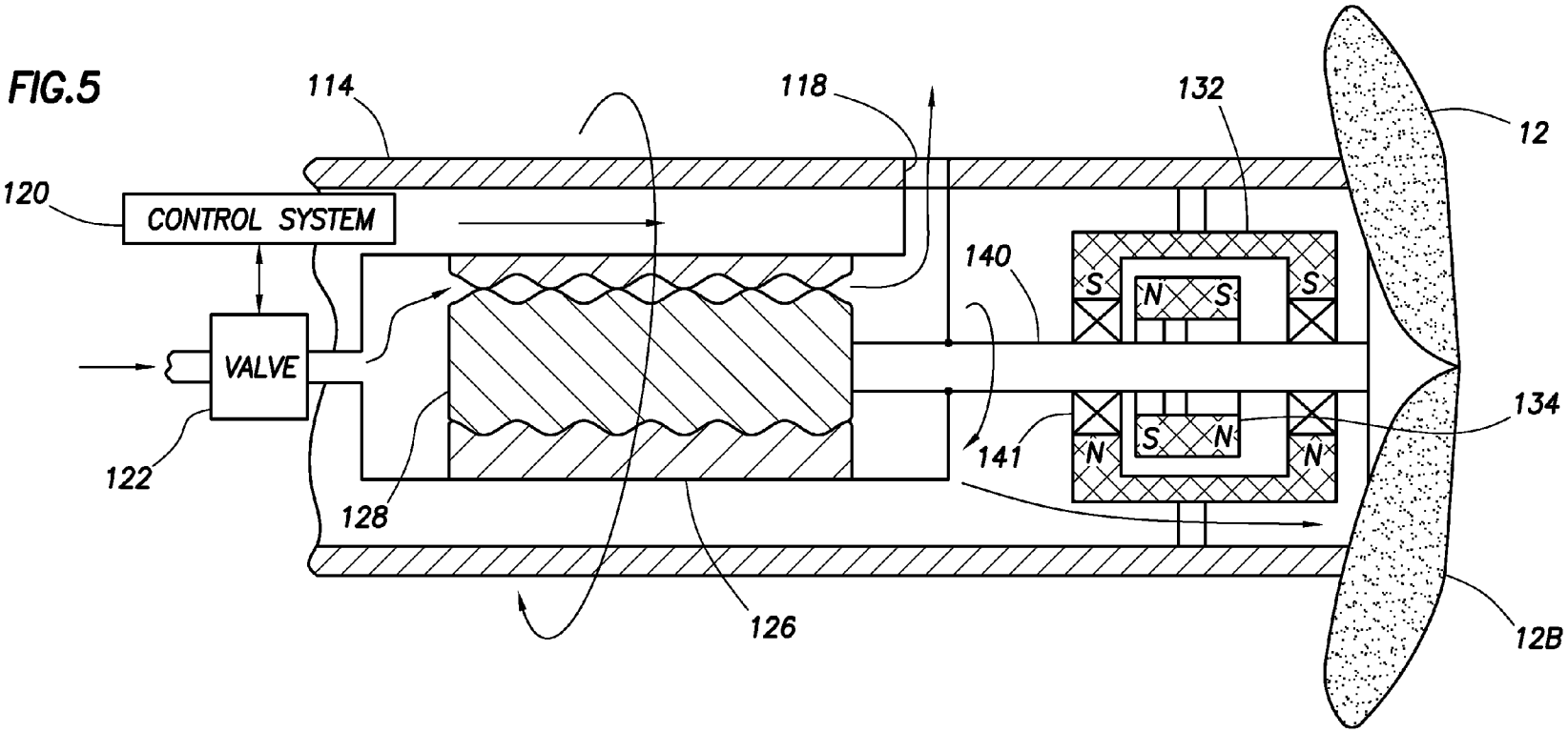
FIG. 5 shows another example of a steering system.

FIG. 5 shows another example of the directional drilling system of FIG. 1, in which the motor (stator 186 and rotor 128) is disposed coaxially within the housing 114, and a drive shaft 140 supported in bearings 141 rotates the shuttle 134. In the present example, the shuttle 134 is disposed inside the circumference of the anvil 132, as contrasted with the arrangement shown in FIG. 1. Operation of the motor may be performed using a valve 122 and control system 120 similar in configuration to those shown in and explained with reference to FIG. 1.

Figure 6:
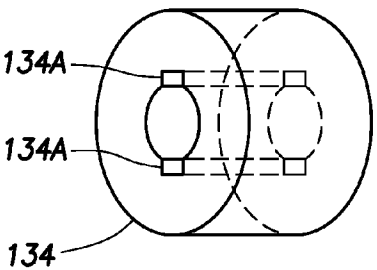
FIG. 6 shows an example of a shuttle used in the system of FIG. 5.

The shuttle 134 of the example of FIG. 5 is shown in oblique view in FIG. 6. The shuttle may include splines 134A to transfer rotation of the driveshaft (140 in FIG. 5) to the shuttle 134. Steering (changing the wellbore trajectory) may be performed using a bit 12 configured substantially as explained above with reference to FIG. 1.

Figure 7:
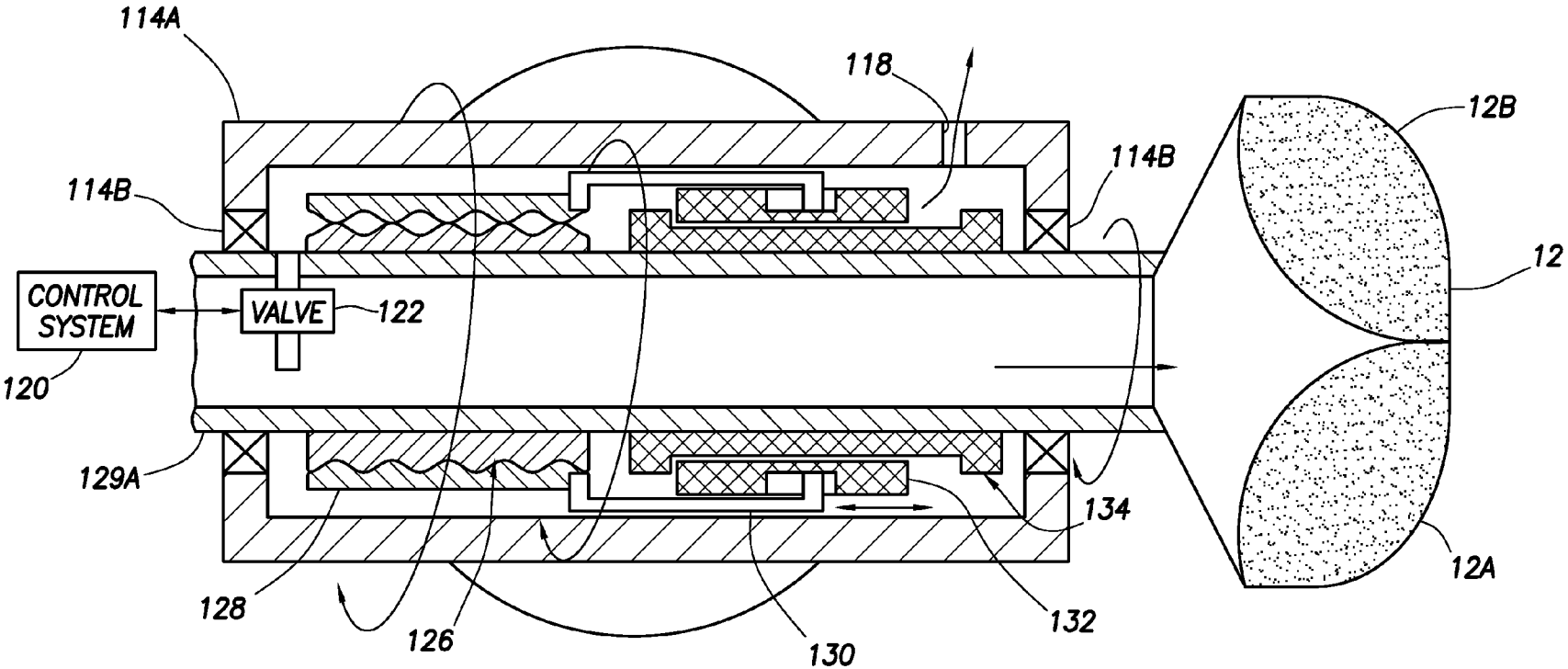
FIG. 7 shows another example of a steering system.
Figure 8:
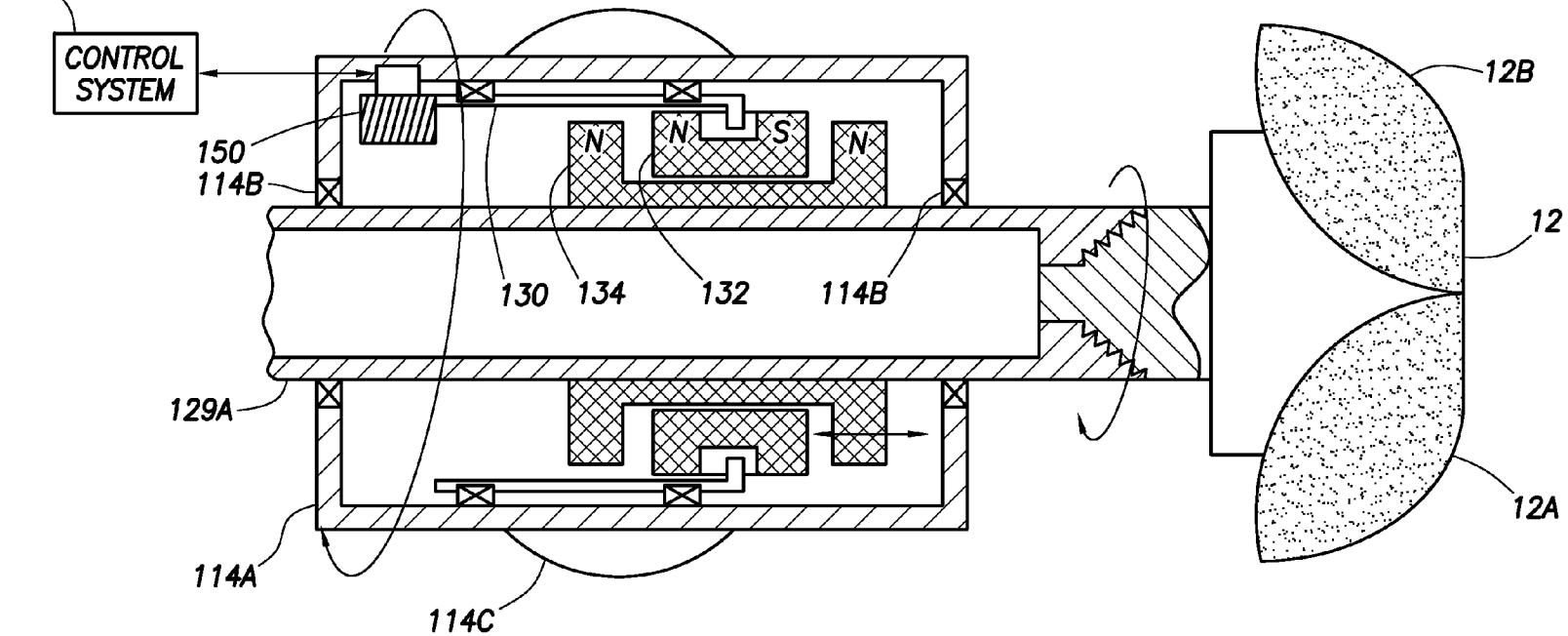
FIG. 8 shows another example of a steering system.
Figure 9:
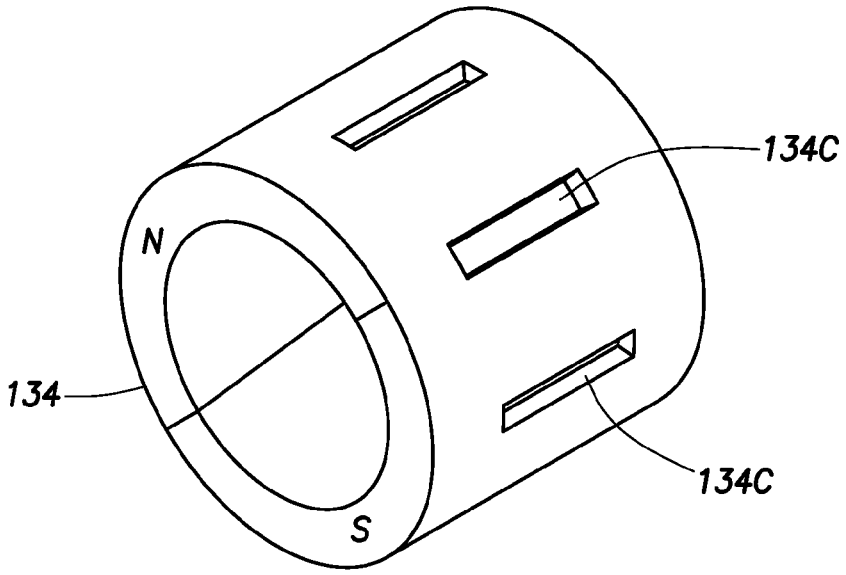
FIG. 9 shows an example of a shuttle for the system in FIG. 8.
Figure 10:
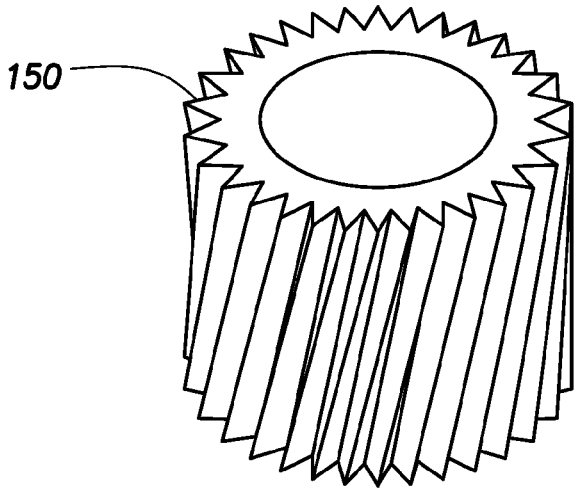
FIG. 10 shows a gear used to drive the shuttle of FIG. 8 by relative rotation.

In another example directional drilling steering system shown in FIG. 7, the housing 114A is rotatably supported on the exterior of the center conduit or tube 129A by bearings 114B. The conduit 129A may be rotationally coupled to the drill string (20 in FIG. 1A). Therefore, the conduit 129A rotates to directly drive the drill bit 12. The conduit 129A may be rotated directly by the drill string (20 in FIG. 1A) and/or by an hydraulic motor (not shown) if one is included in the drill string. In the example of FIG. 7, the shuttle may be rotated by an hydraulic motor, consisting of stator 186 coupled to the exterior of the conduit 129A and a rotor 128 disposed externally to the stator 186 can be operated by selective application of drilling fluid. The drilling fluid may be provided through a valve 122 operated by a control system 120 similar to that explained with reference to FIG. 1. The rotor 128 can be coupled to a drive sleeve 130, which is rotationally coupled to the shuttle 134, just as in the example of FIG. 1. The shuttle 134 cooperates with an anvil 132 to cause selective impact to the housing 114A. The shuttle 134 and anvil 132 may include magnets configured, for example, as explained with reference to FIGS. 2 and 3, to convert rotation of the shuttle 134 into reciprocating linear motion of the anvil 132. The bit 12 may include an aggressive side 12B and a less aggressive side 12A to enable steering by selective application of anvil impacts, similar to the technique explained with reference to FIG. 1. In another example directional drilling steering system shown in FIG. 8, the housing 114A is rotatably supported on the conduit 129A by bearings 114B as in FIG. 7. The housing 114A in FIG. 8, however, may include stabilizer blades 114C which may keep the housing 114A rotationally fixed in the wellbore (or at least rotating sufficiently slowly for the control system 120 to be able to operate successfully). Thus, when the conduit 129A is rotated to turn the bit 12, the housing 114A rotates relative thereto (i.e., it is notionally non rotating with respect to the wellbore wall). A gear 150 (also shown in oblique view in FIG. 10) may convert the relative rotation into rotation of the drive coupling 130. The drive coupling 130 engages the shuttle 132 in a manner similar to the engagement shown in FIG. 1, or may include engagement slots (134C in FIG. 9) on the exterior surface thereof the shuttle 132. The drive sleeve 130, which can be rotated with respect to the housing 114A to adjust the phase of the impacting of the anvil 134 to coincide with the 12 bit's aggressive face 12A pointing along a selected direction. Control over relative rotation and the timing of anvil impact may be performed by a control system, such as explained with reference to FIG. 1.

Figure 11:
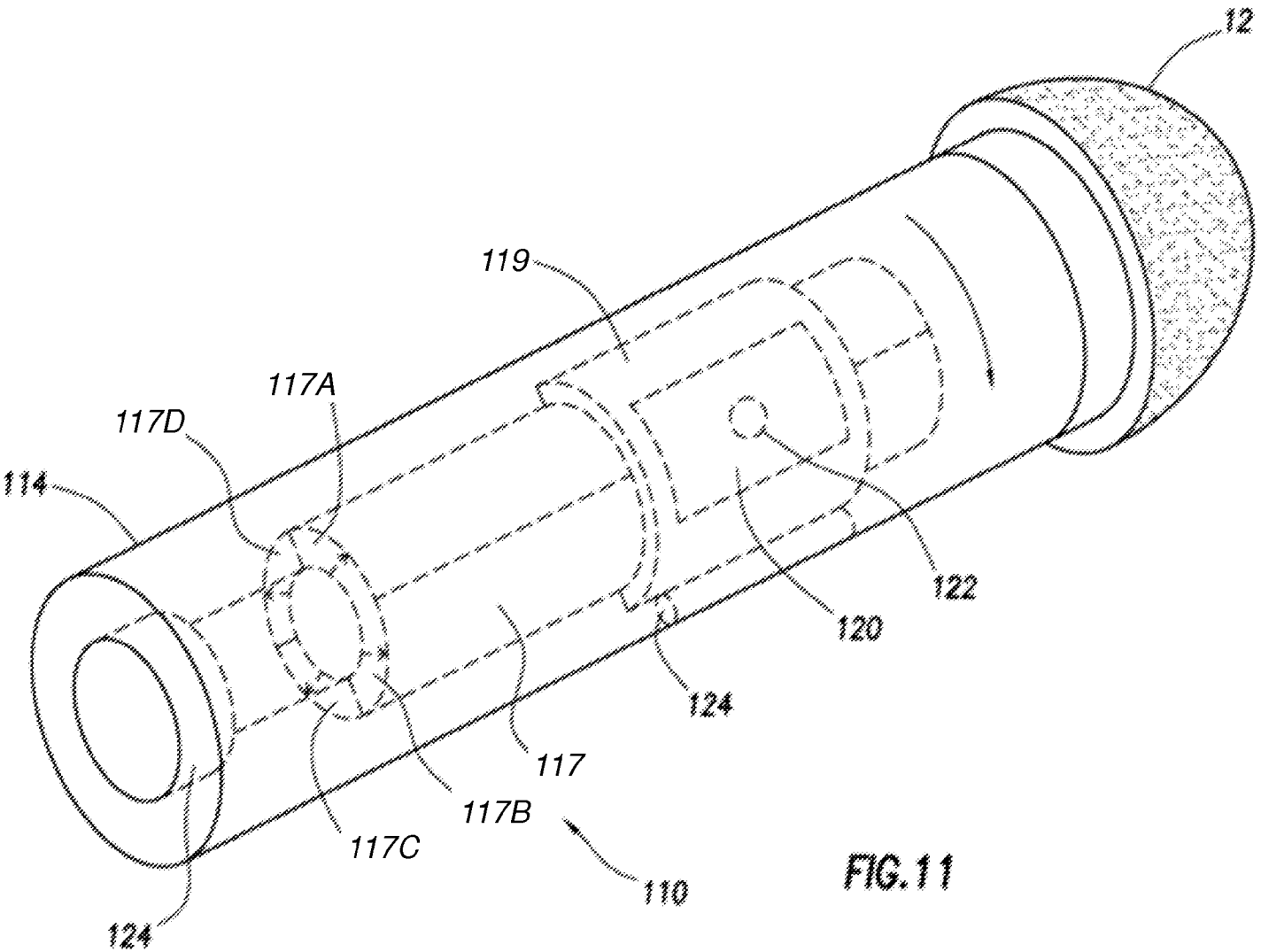
FIG. 11 shows another example of a steering system.

Another example of a directional drilling steering system that can use conventional, rotationally symmetric drill bits is shown in FIG. 11. The system 110 includes a housing or collar 114 that can be coupled at one end to the drill string (20 in FIG. 1A). The other end of the housing 114 may be coupled to another component of the drill string or to a drill bit 12, which can be a conventional, rotationally symmetric drill bit or other type of drill bit known in the art. The housing 114 may include one or more steering pads 119 coupled to the exterior surface thereof by a hinge or pivot 124. The hinge 124 may be disposed on one side of the steering pad 119 toward the direction of rotation of the housing 114 during drilling indicated by the arrow. The steering pad 119 may be actuated by an operating rod 122 that passes through a suitably sized opening in the housing 114. The actuating rod 122 may be in contact with a magnet 120 disposed inside the housing 114. The magnet 120 may be in the shape of an arcuate segment and polarized in the direction indicated by the arrow on its edge. Inside the housing 114 may be disposed a magnet shuttle 117 which may be in the shape of an annular cylinder. The shuttle 117 may be assembled from a plurality of arcuate segment magnets 117A, 117B, 117C, 117D polarized radially in alternating directions as shown by the arrows on the edges thereof. The shuttle 117 may be rotated by a motor 124. The motor 124 may be an hydraulic motor operated by the flow of drilling fluid (controlled, e.g., as shown in FIG. 1) or may be an electric motor.

When the shuttle 117 is rotated, the magnetic flux polarity thereof directed toward the pad operating magnet 120 alternates, such that the pad 119 is alternatingly extended or urged away from the housing 114 and retracted or pulled toward the housing 114. By causing the rotation of the motor 124 to correspond to rotation of the housing 114 (e.g., rotated by the drill string), extension of the pad 119 may be caused to occur repeatedly in a selected rotary orientation. By repeating extension of the pad 119 in such rotary orientation, the wellbore trajectory may be changed. The example shuttle 117 shown in FIG. 11 includes four actuate segment magnets, however more or fewer arcuate magnet segments may be used in other examples. Other examples may include more than one steering pad, operating rod and associated magnet disposed circumferentially around the housing 114. The number of steering pads and associated operating components is therefore not intended to limit the scope of the present invention.

Figure 12:
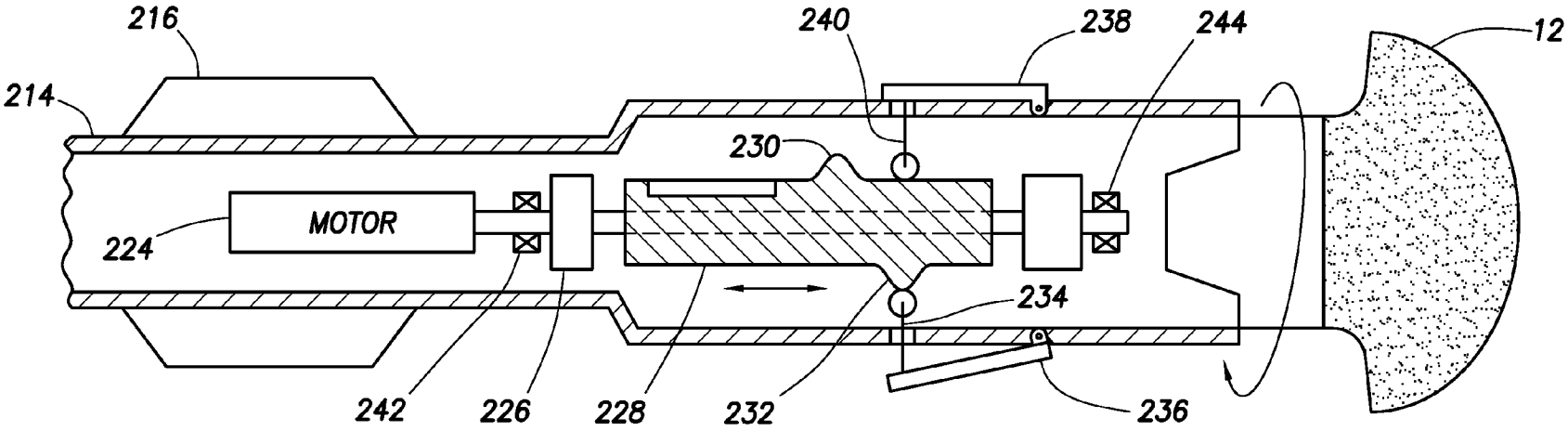
FIG. 12 shows another example of a steering system.

Another example directional drilling steering system is shown in FIG. 12. The system shown in FIG. 12 may be disposed in a housing 214 configured to be coupled into a drill string. A drill bit 12 may be coupled to one end of the housing 214. The housing 214 may include an integral or affixed blade stabilizer 216. The housing may be rotated by a drill string (not shown) to cause corresponding rotation of the bit 12 to drill a wellbore. The housing 214 may include one or more, hinged, articulated steering pads 236, 238 disposed at circumferentially spaced apart positions along the exterior of the housing 214. The pads 236, 238 may be selectively extended from the housing 214 by corresponding operating rods 238, 240. The operating rods are actuated (extended laterally) by the action of corresponding cams 230, 232 on a magnetic anvil 228. The anvil may include magnets configured similarly to the anvil shown in FIG. 1. A magnetic shuttle 226 may be configured similarly to the shuttle shown in FIG. 1, such that when the shuttle 226 is rotated, the anvil 228 is caused to move longitudinally within the housing 214. Such longitudinal movement alternatingly causes the cams 230, 232 to actuate the corresponding operating rods 238, 240, which causes corresponding extension and retraction of the steering pads 236, 238. The shuttle 226 may be rotated by a motor 2224, such as an hydraulic or electric motor. The rotation of the shuttle 226 may be selected to cause operation of the pads 236, 238 at selected rotary orientation so as to cause change in the trajectory of the wellbore during drilling.

Figure 13:
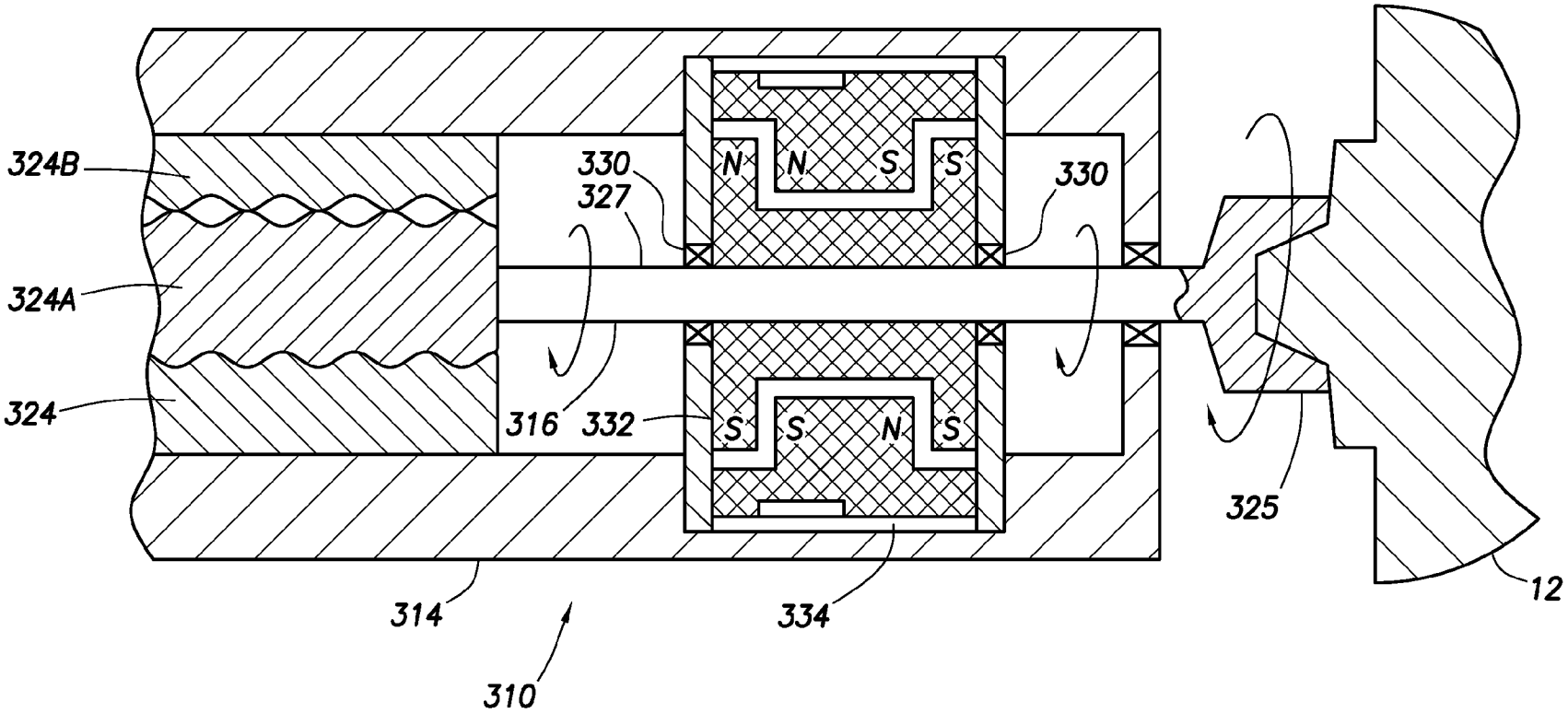
FIG. 13 shows an example of a drilling motor that includes an axial impact generator using a magnetic motion converter.

An example drilling motor that uses a magnetic motion converter to generate impacts for drilling is shown in FIG. 13. The motor 310 may be disposed in a housing 314 configured to couple within the drill string (20 in FIG. 1A). The housing 314 may include a conventional positive displacement power generation section 324 including a stator 324B and a rotor 324A. The power generation section may alternatively include a turbine (not shown). The rotor 324A is coupled to a flexible coupling 316 of a type conventionally used in fluid operated drilling motors to enable relative movement between the rotor and the bit, i.e., the stator of the motor rolls around the stator surface giving rise to both a rotation of the shaft (i.e. the shaft turns the drill bit) and a precession of the rotor center line as it rolls around the radius of eccentricity.—The coupling between the rotor and the bit is typically either a flex shaft or two knuckle joints. A drive shaft 327 includes at one end a bit box 325 which couples to the drill bit 12 to rotate the bit. The drive shaft 327 is rotatably supported in the housing by bearings 330, which may be conventional drilling fluid lubricated bearings or oil lubricated bearings. The drive shaft 327 also rotates a magnetic shuttle 332, which may be similar in configuration to the shuttle shown in FIG. 1. The shuttle 332 rotates inside a magnetic anvil 334, which may be configured similarly to the anvil shown in FIG. 1. As a result, rotation of the shuttle 332 causes reciprocating longitudinal motion of the anvil 334. The anvil 334 is disposed in the housing 314 to strike the lower longitudinal end thereof so as to impart impacts to the drill bit 12. The impacts may increase the rate at which subsurface rock formations are drilled by the bit 12. As in a conventional bent housing mud motor used to directionally steer the well, the axis of the bit can be tilted to provide a means of establishing the direction of the wellbore trajectory.—In the present example the motor is used to rotate the bit to improve drilling efficiency as usual but rate of penetration can be enhanced with the hammer effect driven off the same motor.

Figure 14:
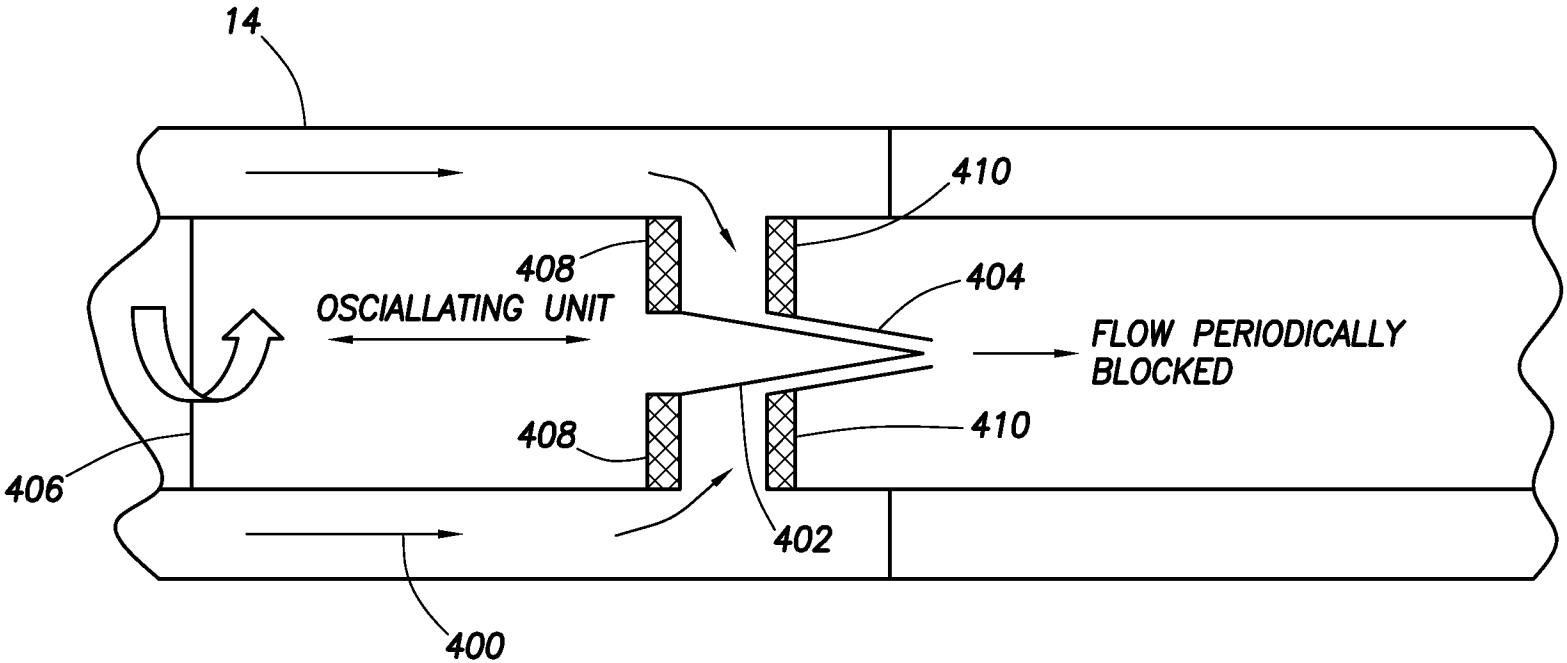
FIG. 14 shows an example fluid flow modulation telemetry transmitter.

FIG. 14 shows an example of a fluid flow modulation telemetry transmitter that may use a rotating shuttle/anvil arrangement such as shown in FIG. 1. A combination rotating magnetic shuttle and anvil assembly is shown generally at 406 and is disposed in a housing 14 configured to be coupled within a drill string. The shuttle and anvil assembly may be configured substantially as shown in FIG. 1, such that rotation of the shuttle causes longitudinal reciprocating motion of the anvil. The anvil may be coupled at one longitudinal end to a valve stem 402. Magnets 408 may be disposed circumferentially about the valve stem 402 and polarized in a direction parallel to the axis of the valve stem 402. The valve stem 402 may be selectively extended into a valve seat 404 disposed in the housing 14, such that extension of the stem therein restricts or interrupts flow of fluid 400, e.g., drilling fluid. Corresponding, oppositely polarized magnets 410 may be disposed about the valve seat 404 such that the valve stem 402 may be readily retracted from the valve seat 404 when the anvil is moved in such direction. The shuttle may be operated by a motor to cause operation of the anvil at selected times to encode signals from any device associated with the drill string. Even without drilling fluid flow or control thereof it is contemplated that the impact alone can be used to transmit information by creating stress waves in the drilling structure and fluid.

Figure 15:
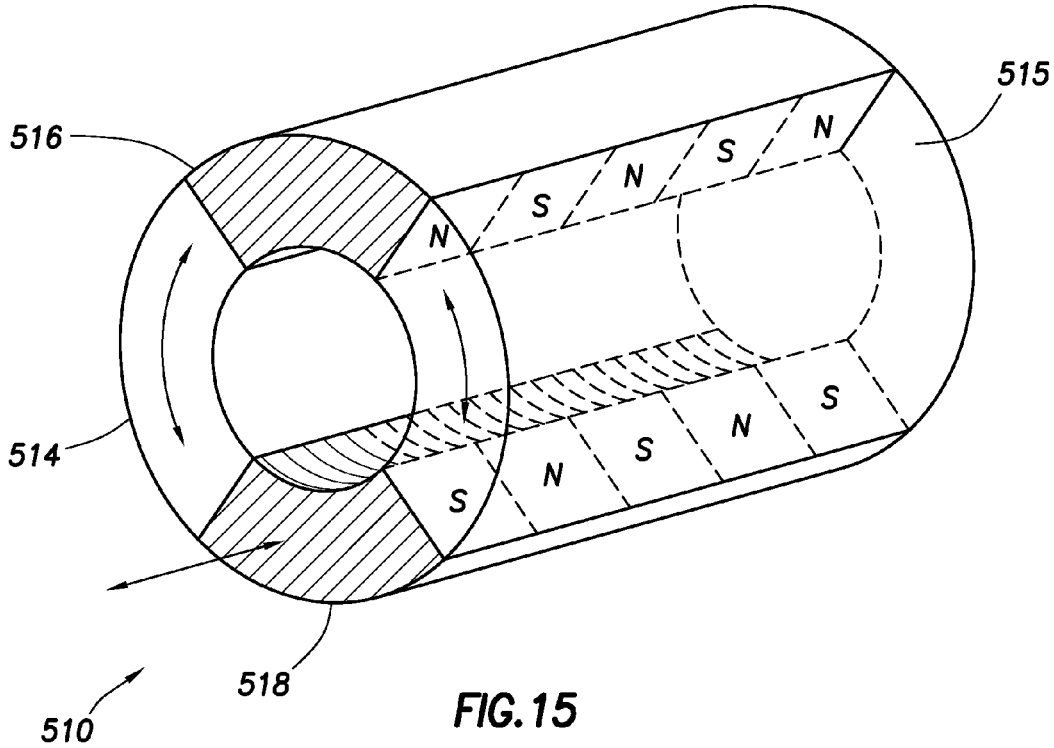
FIGS. 15 and 16 show an example of a magnetic torsional hammer.
Figure 16:
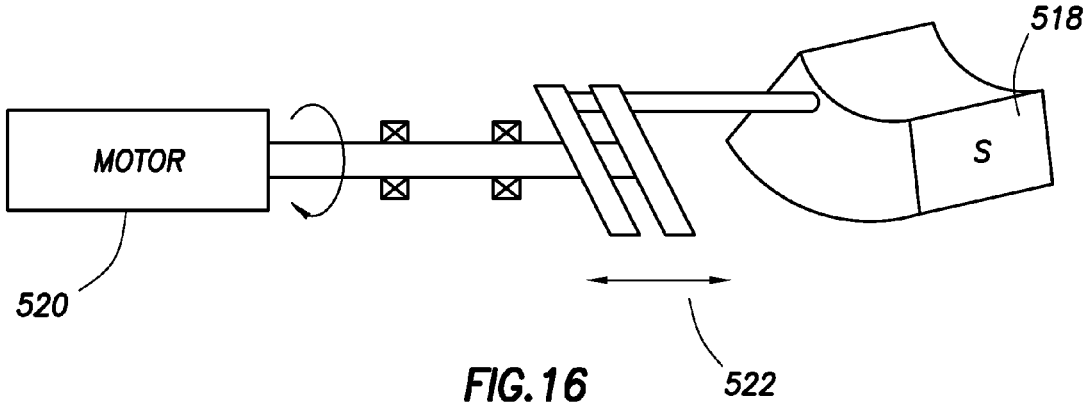

FIGS. 15 and 16 show an example of a torsional hammer that may be used to alleviate rotational "stick slip" motion of a drill string and to enhance ROP by jolting the bit in the radial direction to remove the rock by attaining much higher transient torque at the drill bit. Referring first to FIG. 15, the hammer 510 may be disposed in a housing 514 configured to couple within the drill string (20 in FIG. 1A). The housing 514 may define an annular space therein. The annular space 515 may include two arcuate sets of alternatingly polarized magnets 516, 518. The magnets in each set have alternating magnetic polarity as shown in FIG. 15. One magnet set 518 is in a fixed circumferential position within the annular space 515, and is free to move longitudinally within the space 515. The other magnet set 516 is longitudinally fixed, but may move circumferentially within the annular space. Referring to FIG. 16, the longitudinally movable magnet set 518 may be coupled to a reciprocator such as a swash plate 522 operated by a motor 520. Operation of the motor and swash plate may be configured to cause the magnet set 518 to move the distance of one magnet in the set. Thus, the polarity of the magnet set 518 with respect to the longitudinally fixed magnet set 516 is alternated. By alternating the magnet polarity of the circumferentially fixed magnet set 518 with respect to the circumferentially movable magnet set 516, the circumferentially movable magnet set 516 may be caused to move circumferentially back and forth in the annular space, causing torsion pulses in the housing 514. The torsion pulses may reduce torsional stick slip motion during drilling a wellbore. The air gaps are shown exaggerated in the figures for clarity of the illustration.

Figure 17:
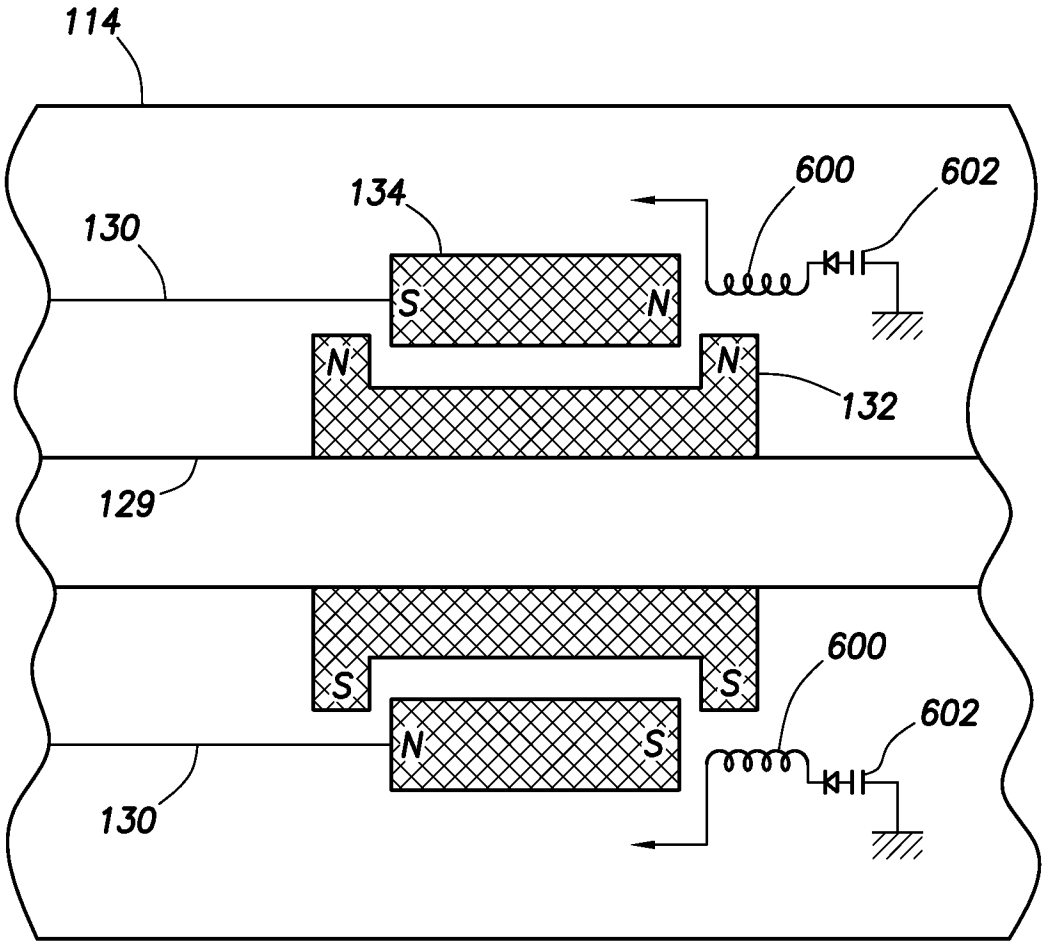
FIG. 17 shows an example magnetic motion converter including an electric generator associated therewith.

In some examples, an electric generator or alternator may be associated with the magnetic motion converter to extract electric power from motion of the converter. The electric power may be used to operate electronic devices, for example, in the drill string (20 in FIG. 1A) such as LWD and/or instrumentation. FIG. 17 shows a shuttle 134 coupled to a drive sleeve 130 similar to the arrangement shown in FIG. 1. The shuttle may include magnets arranged such as shown in FIG. 1. The drive sleeve 130 may be coupled to a fluid operated motor, such as shown in FIG. 1. An anvil 34 is disposed about a central conduit 129 also as explained with reference to FIG. 1 and may include magnets arranged as explained with reference to FIG. 1. The anvil 134 may have disposed proximate thereto alternator windings 600, such that motion of the anvil 134 will induce electric current in the windings 600. The windings 600 may be electrically connected to a respective energy storage device 602 such as a battery or capacitor. Electric power induced in the windings 600 and stored in the storage device 602 may be used to operate one or more electronic devices (not shown). In other examples, alternator windings may be disposed proximate the shuttle so that rotation of the shuttle will induce electric current in the windings. It may also be possible to use the sharp change in velocity of the magnets in proximity to windings to generate specialized voltage pulse shapes for high voltage applications like electro pulse drilling. Such drilling techniques could also be combined with the basic hammer action of the motion converter.

Figure 18:
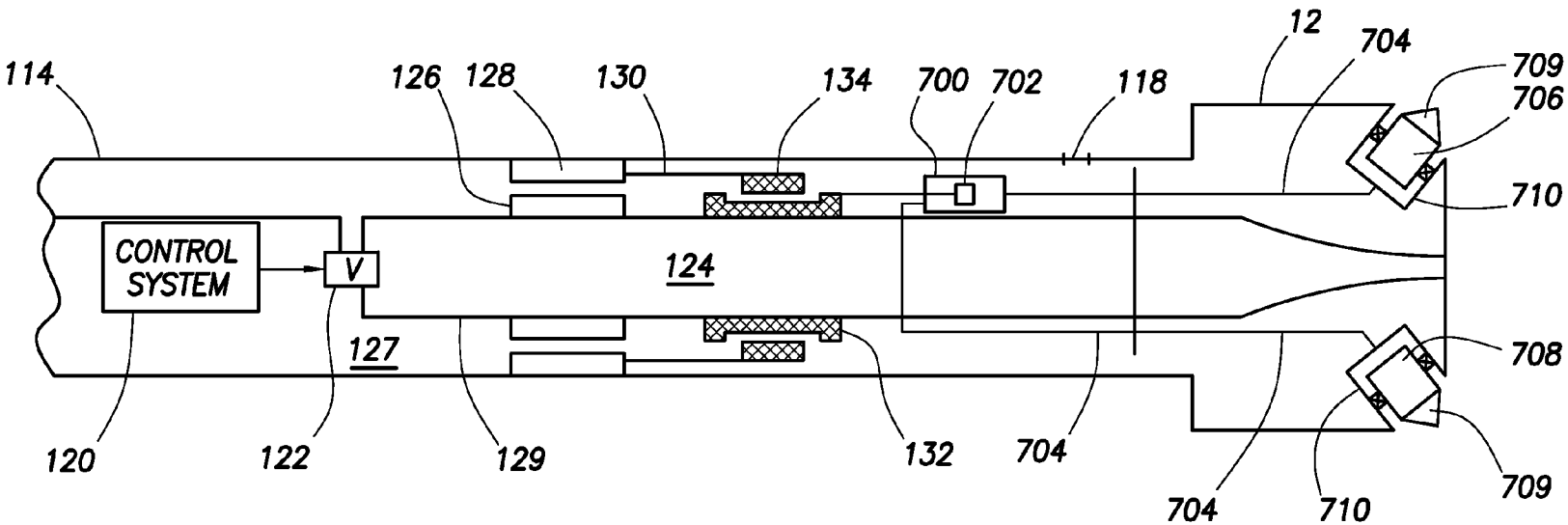
FIG. 18 shows another example of a directional drilling steering system using a magnetic shuttle.

Another example of a directional drilling steering system is shown in FIG. 18. Components of the system in FIG. 18 that are similar to those in the system explained with reference to FIG. 1 are designated using the same reference numerals as those explained with reference to FIG. 1. The system shown in FIG. 18 may include an hydraulic motor (consisting of rotor 128 and stator 186) disposed in an annular space 127 defined by a central conduit 129. As in the example explained with reference to FIG. 1, drilling fluid may be selectively caused to enter the annular space and thereby operate the hydraulic motor. Such selective admittance of the drilling fluid may be controlled by a control system 120 in signal communication with a valve 122. A magnetic motion converter is rotationally coupled to the rotor 128 and includes a shuttle 134 and an anvil 132. The anvil 132 may be disposed on the exterior surface of the conduit 129 so that the anvil 132 is constrained to move longitudinally. When the shuttle 134 is rotated, magnets (arranged therein as shown in FIG. 3) cooperate with magnets on the anvil 132 (arranged as shown in FIG. 2) such that the anvil 132 moves longitudinally back and forth along the conduit 129.

In the present example, the reciprocating linear motion of the shuttle 132 may operate a bi-directional hydraulic pump 700, including a piston 702 disposed therein. Output of each side of the piston 700 is coupled through an associated hydraulic line 704 to a corresponding hydraulic cylinder 710 at the lower end of the drill bit 12. Each hydraulic cylinder 710 includes a piston 708 therein. Each piston 708 supports a cutting element 709 such as a PDC cutter. During drilling operations, the control system 120 may operate in response to rotational orientation signals (e.g., from the LWD system 14 in FIG. 1A) to admit drilling fluid to the motor at a rate selected to cause rotation of the motor to be substantially synchronized with rotation of the housing 114 (provided, e.g., by the top drive or by a mud motor). Each time the motor rotates, the shuttle 132 moves through a selected number of reciprocations depending on the magnet configuration thereof and that of the anvil 134. Each such reciprocation will cause corresponding reciprocation of the pump piston 702. Each reciprocation of the pump piston 702 will cause corresponding extension of one of the bit pistons 708, and contemporaneous retraction of the other bit piston 708. By synchronizing the extension of the bit pistons 708 with rotation of the housing 114 and the drill bit 12, it is possible to cause the trajectory of the wellbore to turn according to the rotary orientation of the bit 12 at the time each bit piston 708 is extended.

Drilling and measurement systems according to the various aspects of the invention may have fewer moving parts, fewer necessary sealing elements and therefore have greater reliability than motors and associated components for drilling and measurement known in the art prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A directional drilling apparatus, comprising:

a housing configured to couple to a drill string;

a plurality of magnets disposed in the housing and configured to convert rotation to reciprocating motion, the magnets configured to impart impacts to the housing by the reciprocating motion;

a motor coupled to the magnets to apply rotation to a part thereof; and a control system configured to operate the motor such that the impacts occur when the housing is in a selected rotational orientation, wherein the control system comprises a controller and an electrically operated valve in signal communication with the controller.

2. The apparatus of claim 1 further comprising a drill bit coupled to one end of the housing, the drill bit having different formation drilling properties in at least one circumferential portion than in any other circumferential portion thereof.

3. The apparatus of claim 1 wherein the plurality of magnets comprises alternatingly polarized, circumferentially segmented magnets disposed at each longitudinal end of a cylinder, the cylinder disposed within an opening defined within the annular cylinder of longitudinally polarized magnets.

4. The apparatus of claim 1 wherein the housing is rotatably supported externally to a drive shaft, the drive shaft configured to be rotationally coupled to the drill string, and wherein the motor comprises a linkage between the housing and the plurality of magnets whereby relative rotation between the housing and the drive shaft rotates a part of the plurality of magnets.

5. The apparatus of claim 1 further comprising at least one generator winding disposed proximate the magnets and configured to generate electric current in response to motion of the magnets.

6. The apparatus of claim 1 wherein the plurality of magnets are configured to cause lateral extension of a device from a center axis of the housing by the reciprocating motion and further wherein the control system is configured to operate the motor such that the extension occurs when the housing is in a selected rotational orientation.

7. The apparatus of claim 6 wherein the device comprises a steering pad disposed on an exterior of the housing and in operable contact with a reciprocating part of the plurality of magnets.

8. The apparatus of claim 6 wherein the device comprises at least one cam disposed on a reciprocating part of the magnets, the cam operable to cause lateral extension of a steering device from the central axis when in contact therewith.

9. The apparatus of claim 6 further comprising at least one generator winding disposed proximate the magnets and configured to generate electric current in response to motion of the magnets.

10. A directional drilling apparatus, comprising:

a housing configured to couple to a drill string;

a plurality of magnets disposed in the housing and configured to convert rotation to reciprocating motion, the magnets configured to operate longitudinally extensible cutting elements on a drill bit in response to the reciprocating motion;

a motor coupled to the magnets to apply rotation to a part thereof; and a control system configured to operate the motor such that longitudinal extensions of the cutting elements occur when the housing is in a selected rotational orientation, wherein the control system comprises a controller and an electrically operated valve in signal communication with the controller.

11. The apparatus of claim 10 wherein the plurality of magnets comprises an annular cylinder including alternatingly longitudinally polarized magnets.

12. The apparatus of claim 11 wherein the plurality of magnets comprises alternatingly polarized, circumferentially segmented magnets disposed at each longitudinal end of a cylinder, the cylinder disposed within an opening defined within the annular cylinder of longitudinally polarized magnets.

13. The apparatus of claim 10 wherein the housing is rotatably supported externally to a drive shaft, the drive shaft configured to be rotationally coupled to the drill string, and wherein the motor comprises a linkage between the housing and the plurality of magnets whereby relative rotation between the housing and the drive shaft rotates a part of the plurality of magnets.

14. The apparatus of claim 10 wherein the longitudinally extensible cutting elements are each coupled to a respective piston disposed in a corresponding hydraulic cylinder, and wherein the plurality of magnets are configured to operate an hydraulic pump functionally coupled to the hydraulic cylinders.

15. A directional drilling apparatus, comprising:

a housing configured to couple to a drill string;

a plurality of magnets disposed in the housing and configured to convert rotation to reciprocating motion, the magnets configured to impart impacts to the housing by the reciprocating motion;

a motor coupled to the magnets to apply rotation to a part thereof; and a control system configured to operate the motor such that the impacts occur when the housing is in a selected rotational orientation;

wherein the plurality of magnets are configured to cause lateral extension of a device from a center axis of the housing by the reciprocating motion, wherein the control system is configured to operate the motor such that the extension occurs when the housing is in a selected rotational orientation, and wherein the device comprises a steering pad disposed on an exterior of the housing and in operable contact with a reciprocating part of the plurality of magnets.

16. A directional drilling apparatus, comprising:

a housing configured to couple to a drill string;

a plurality of magnets disposed in the housing and configured to convert rotation to reciprocating motion, the magnets configured to impart impacts to the housing by the reciprocating motion;

a motor coupled to the magnets to apply rotation to a part thereof; and a control system configured to operate the motor such that the impacts occur when the housing is in a selected rotational orientation;

wherein the plurality of magnets are configured to cause lateral extension of a device from a center axis of the housing by the reciprocating motion, wherein the control system is configured to operate the motor such that the extension occurs when the housing is in a selected rotational orientation, and wherein the device comprises at least one cam disposed on a reciprocating part of the magnets, the cam operable to cause lateral extension of a steering device from the central axis when in contact therewith.

17. A directional drilling apparatus, comprising:

a housing configured to couple to a drill string;

a plurality of magnets disposed in the housing and configured to convert rotation to reciprocating motion, the magnets configured to operate longitudinally extensible cutting elements on a drill bit in response to the reciprocating motion;

a motor coupled to the magnets to apply rotation to a part thereof; and a control system configured to operate the motor such that longitudinal extensions of the cutting elements occur when the housing is in a selected rotational orientation, wherein the longitudinally extensible cutting elements are each coupled to a respective piston disposed in a corresponding hydraulic cylinder, and wherein the plurality of magnets are configured to operate an hydraulic pump functionally coupled to the hydraulic cylinders.

* * * * *